US008210391B2

(12) United States Patent
Luburic

(10) Patent No.: US 8,210,391 B2
(45) Date of Patent: Jul. 3, 2012

(54) PERFORMANCE ORIENTED PAIL

(75) Inventor: Frano Luburic, Anaheim, CA (US)

(73) Assignee: ROPAK Corporation, Fountain Valley, CA (US)

( * ) Notice: Subject to any disclaimer, the term of this patent is extended or adjusted under 35 U.S.C. 154(b) by 879 days.

(21) Appl. No.: 11/250,589

(22) Filed: Oct. 14, 2005

(65) Prior Publication Data

US 2007/0084870 A1 Apr. 19, 2007

(51) Int. Cl.
*B65D 25/24* (2006.01)
*B65D 6/00* (2006.01)
*B65D 21/00* (2006.01)

(52) U.S. Cl. ..... 220/635; 220/669; 206/508

(58) Field of Classification Search ..... 220/634, 220/669, 17.2, 17.3, 760, 773, 378, 795, 220/276, 322, 765
See application file for complete search history.

(56) References Cited

U.S. PATENT DOCUMENTS 1,351,900 A * 9/1920 Freundt ..... 220/842
1,598,951 A * 9/1926 Wright ..... 426/87
3,358,875 A 12/1967 Ekstrom
3,425,382 A * 2/1969 Johnson ..... 413/1
3,556,338 A 1/1971 Wilkinson
3,696,962 A 10/1972 Fehres et al.
3,753,511 A 8/1973 Ruch
3,840,152 A 10/1974 Hodge
3,949,877 A * 4/1976 Santoni ..... 206/519
4,209,107 A 6/1980 Crisci
4,228,916 A 10/1980 Weingardt
4,252,248 A 2/1981 Obrist et al.
4,256,240 A 3/1981 Woinarski
4,293,073 A * 10/1981 Yates, Jr. ..... 206/519
4,293,080 A 10/1981 Letica
4,349,119 A 9/1982 Letica
4,412,630 A 11/1983 Daenen
4,418,883 A 12/1983 Cohen
4,444,332 A 4/1984 Wilden et al.
4,453,647 A 6/1984 Neat
4,471,880 A 9/1984 Taylor et al.
4,538,741 A 9/1985 Jacobs
4,674,650 A * 6/1987 Hamilton et al. ..... 220/319
4,735,337 A 4/1988 Von Holdt
4,768,668 A 9/1988 Van Den Brink
4,781,301 A * 11/1988 Le Bret et al. ..... 220/672
4,887,736 A 12/1989 Vancucha
4,934,554 A 6/1990 Edwards
4,966,302 A 10/1990 Hjordie
5,065,887 A 11/1991 Schuh et al.
5,186,318 A 2/1993 Oestreich et al.
5,292,024 A * 3/1994 Koefelda et al. ..... 220/608
5,310,075 A 5/1994 Wyler
5,344,041 A * 9/1994 Luburic et al. ..... 220/760
5,356,026 A 10/1994 Andress et al.
5,392,024 A * 2/1995 Kiuchi et al. ..... 340/436
5,427,264 A * 6/1995 Addison ..... 220/792

(Continued)

*Primary Examiner* — Bryon Gehman
*Assistant Examiner* — Shawn Braden
(74) *Attorney, Agent, or Firm* — Vedder Price P.C.

(57) ABSTRACT

A container comprising a pail, removable cover, and a gasket disposed between the cover and the pail is disclosed. The pail has an angled bead at the proximal end of the pail and a plurality of satellite rings that extend circumferentially around the pail and form a wall junction with the pail. The wall junction has a substantially constant wall thickness. A bail ear is formed to connect at least two of the satellite rings to define an opening between the bail ear and the body. The pail also includes a shock absorbing wall section.

8 Claims, 8 Drawing Sheets

U.S. PATENT DOCUMENTS 5,456,375 A 10/1995 May
5,457,850 A 10/1995 Knox
5,549,213 A 8/1996 Robbins et al.
5,617,968 A 4/1997 Luburic
5,626,251 A 5/1997 Lucuric et al.
5,730,309 A * 3/1998 Jiradejnunt et al. ..... 220/276
5,806,710 A 9/1998 Shiffer et al.
5,850,935 A 12/1998 Luburic et al.
5,913,446 A 6/1999 Von Holdt
5,934,500 A 8/1999 Cogger et al.
5,954,223 A 9/1999 Moore
6,098,833 A 8/2000 von Holdt, Sr. et al.
6,164,484 A 12/2000 Fiore et al.
6,168,044 B1 1/2001 Zettle et al.
6,273,291 B1 * 8/2001 Conti ..... 220/781
6,279,774 B1 8/2001 Chute et al.
6,401,957 B1 6/2002 Przytulla
6,497,338 B1 * 12/2002 Stolzman ..... 220/628
6,619,498 B2 9/2003 Von Holdt, Jr.
6,708,839 B2 3/2004 Diesterbeck
6,779,680 B1 * 8/2004 Schwarz ..... 220/773
2002/0146481 A1 * 10/2002 Wust ..... 425/522
2002/0148846 A1 10/2002 Luburic
2002/0148847 A1 * 10/2002 Luburic ..... 220/795
2002/0162846 A1 11/2002 Mercier
2003/0071043 A1 * 4/2003 Davis ..... 220/276
2004/0084465 A1 5/2004 Luburic

* cited by examiner

PERFORMANCE ORIENTED PAIL

BACKGROUND

1. Field of the Inventions

The field of the invention relates generally to storage containers, and more particularly, to an improved injection molded container that can be used for the transport of dangerous goods and hazardous materials.

2. Background Information

Containers such as buckets and pails are known and used in a variety of shapes and sizes to store various materials. A conventional container is comprised of a cylindrical structure with an interior cavity that is closed at one end. The container may also include a removable cover to secure or close the upper opening of the container. A tubular gasket can also be disposed between the upper bead of the container and the cover to provide an improved seal. A handle may also be attached to the container to help facilitate the carrying and handling of the container.

Despite the broad array of containers that exist, current containers, including plastic containers made through an injection molding process, present numerous shortcomings. These shortcomings become particularly evident when current containers are manufactured for use in transporting dangerous goods and hazardous materials. During transport the containers are often stacked on top of each other several containers high. As a result, it is imperative that each container be able to hold within itself the contents of the materials to be transported and stored as well as support the weight of several containers and their respective contents.

The advent of modern transportation by rail and highway, along with the development of more and more hazardous materials, has increased the need to develop safe containers and packaging to safely transport these materials from one destination to another. Design specifications have become a hallmark to ensure that a company's product can be handled and transported safely and arrive intact at its customer's facility.

While the adoption of specification packaging in the United States ensured a level of safety, other countries did not have to accept the United States' standards. In fact, as other countries adopted their own specifications, it became evident that without international standards, incompatible regulations could hinder the free flow of hazardous materials between countries. A solution to this incompatibility and, in some cases, to the lack of regulations, came from the United Nations' (UN) Committee of Experts on the Transport of Dangerous Goods. This included the adoption of standards that could be used by all nations which based packaging not so much on design as the ability of a given package to pass performance tests. By passing a series of tests, a package design proves itself acceptable for both international and domestic transportation of hazardous materials. For example, a container designed to contain liquids is required to pass a drop test, leakproof test, hydrostatic pressure test and a stacking test. The details of such tests are known or are accessible to those of ordinary skill in the art.

Not surprisingly, the designs of current containers, including plastic containers made through known injection molding techniques, typically attempt to increase the strength and rigidity of the container by adding additional material and thickness to regions of the container that are likely to fail. However, in some cases, this design approach can actually lead to increases in the likelihood of a failure. For example, the junction of two or more wall portions of a container made through injection molding techniques leads to a thick cross section. The thick sections found at the wall junctions of the container often experience a region of increased stress and an increased chance of structural failure when the container is subjected to a performance test or while in actual use. This is due to the fact that during the injection molding process, the regions of increased thickness experience increased heating which, in turn, requires an increased amount of time to cool. In addition, the plastic on the outer portion of the wall junction typically cools faster than the plastic at the inside of the wall junction. This often leads to weakness in the plastic that forms the wall junction.

Therefore, the sections of increased thickness found at the wall junction and other regions of the container can be prone to failure during performance tests or while in actual use. Accordingly, the wall junction and other components found in such containers can actually be strengthened by implementing design features that reduce the amount of material that is used to form the wall junction, while at the same time designing the components of the container to absorb or otherwise withstand the stresses the container is subjected to during performance tests or while in actual use.

Reducing the amount of material that is used to form components of the container can provide other benefits in addition to strengthening the product and its components. For example, reducing the amount of material that is used to form the container can provide a plastic container that is more environmentally friendly. In addition, reducing the amount of material required to produce the container simplifies and speeds up the manufacturing process while reducing the ultimate cost of the container. Such benefits that result from using a reduced amount of material to produce the container cannot be realized, however, without design features that ensure the container can meet the standards required by the United Nations' regulations for dangerous goods and hazardous materials and thereby provide the safe transport of such materials.

SUMMARY OF THE INVENTION

A container comprises a body that comprises a proximal end, a distal end and a floor sealing the distal end of the body to define an internal cavity. In one aspect, the body further comprises a shock absorbing wall section. In another aspect, the container also comprises an angled bead formed circumferentially around the proximal end of the body. The angled bead comprises a rim that extends radially outward and toward the distal end of the body.

In another aspect, the container comprises a cover that is configured to be removably coupled to the proximal end of the body. The cover comprises a gripping flange that is configured to interlock with the angled bead. The cover also comprises an angled cover chime that is substantially parallel to the angled bead when the cover is coupled to the body.

In another aspect, the container comprises a gasket positioned in a cavity formed between the gripping flange and the angled bead. The angled cover chime further comprises a gasket retainer bead that extends into the cavity and contacts the gasket.

In another aspect, the container comprises a plurality of satellite rings extending circumferentially around the body and a bail ear connecting at least two satellite rings to form an opening between the bail ear and the body of the pail.

In another aspect, the wall junction formed by the satellite ring and the body comprises a substantially constant wall thickness throughout the wall junction.

DETAILED DESCRIPTION OF THE PREFERRED EMBODIMENTS

Figure 1:
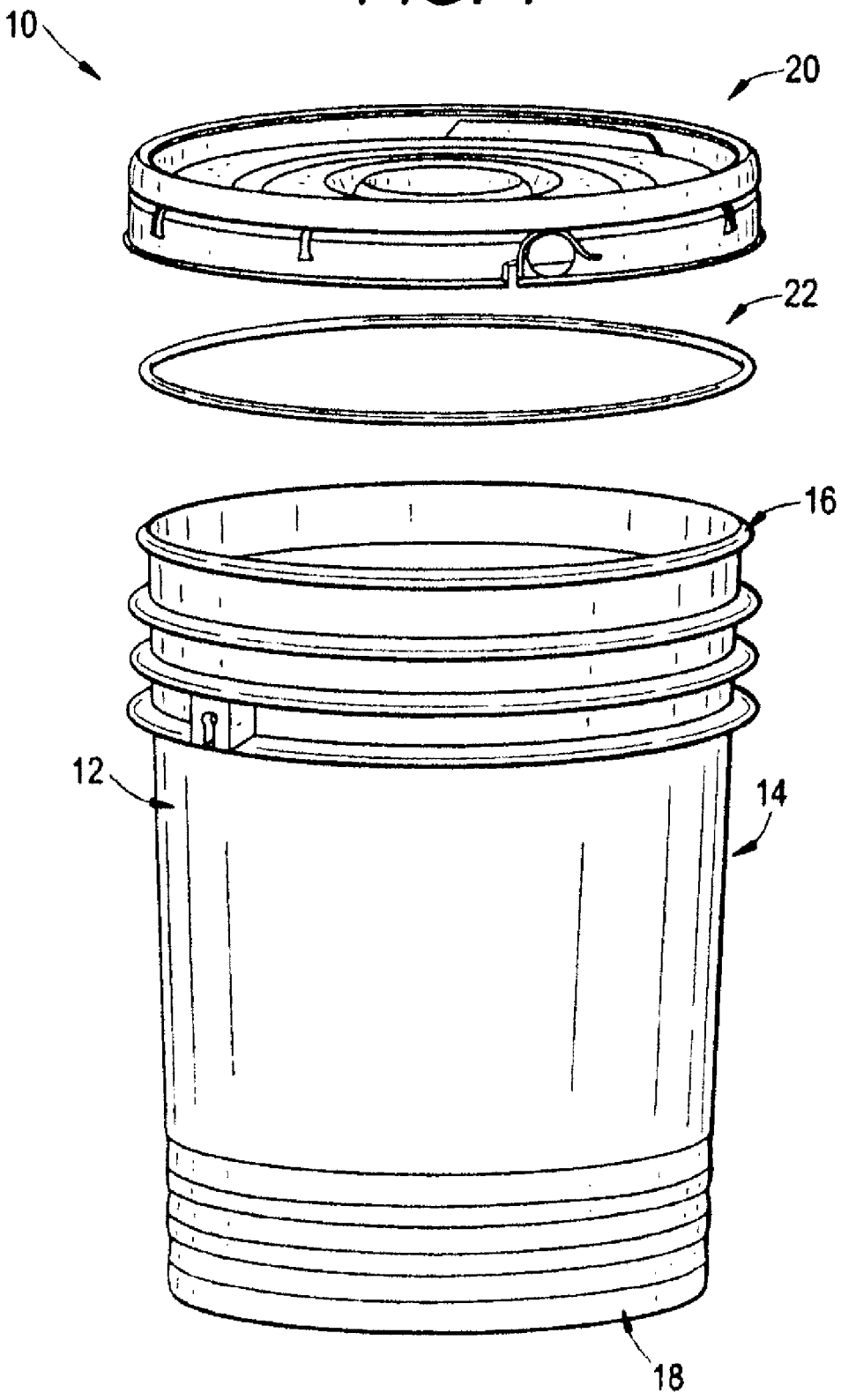
FIG. 1 is a perspective view illustrating the pail, tubular gasket and cover of one embodiment of the invention.
Figure 2:
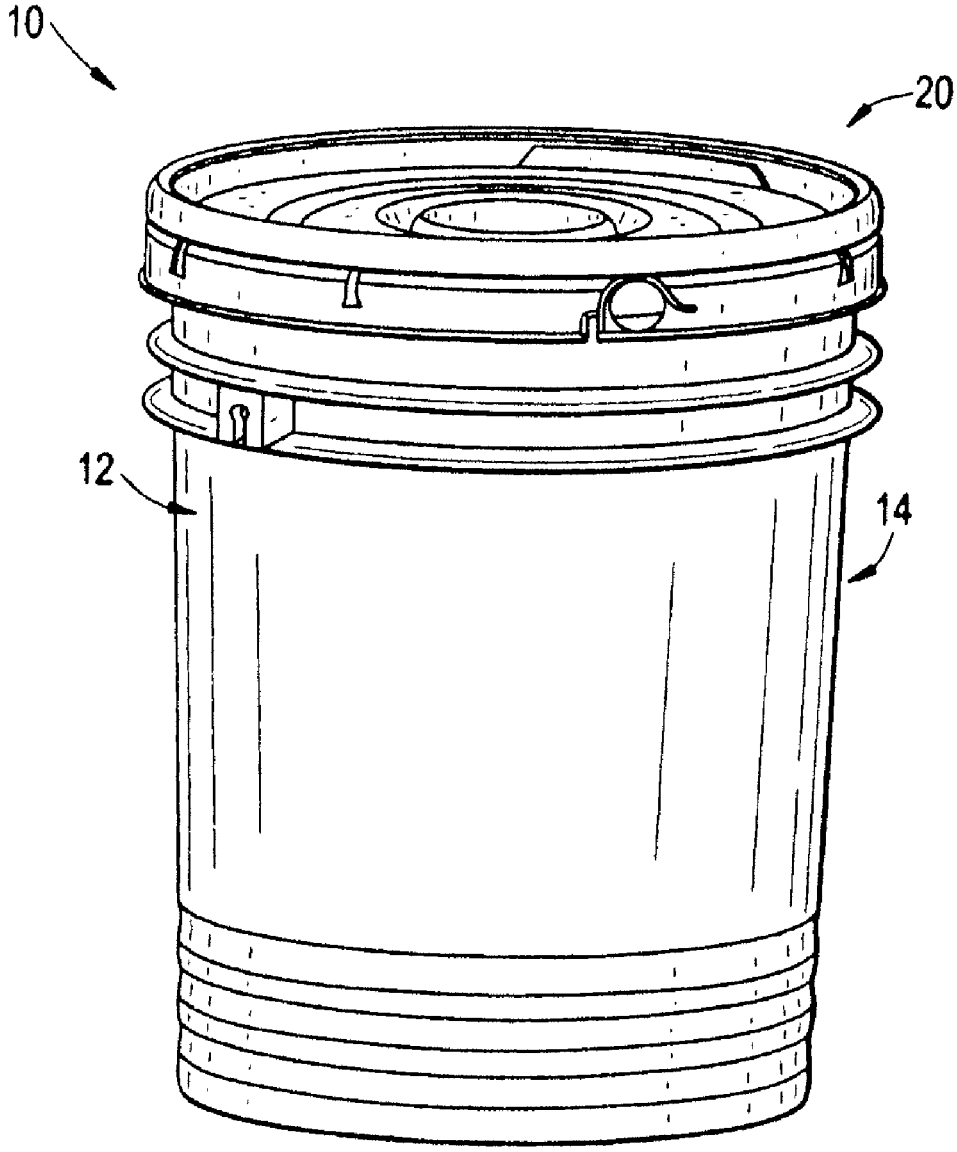
FIG. 2 is a perspective view of the pail and cover in a closed position.

Turning in detail to FIGS. 1 and 2, an exemplary embodiment of a container 10 is illustrated. Container 10 comprises a pail 12 having a body 14 which forms an opening 16 at a proximal end and a closed floor or bottom 18 to seal a distal end of body 14, and an interlocking cover 20 to seal the open proximal end of pail 12. A tubular gasket 22 or other mechanism can be provided between the pail and cover to facilitate a tighter and more secure seal there between. Although the container can take on any number of different configurations, this particular embodiment illustrates pail 12 comprising a substantially cylindrical body 14. Body 14 and bottom 18 are typically formed as a single element (such as through a plastic injection molding process) to define an internal cavity that can be accessed through opening 16, thus allowing pail 12 to contain or store a variety of liquids and other materials.

Figure 3:
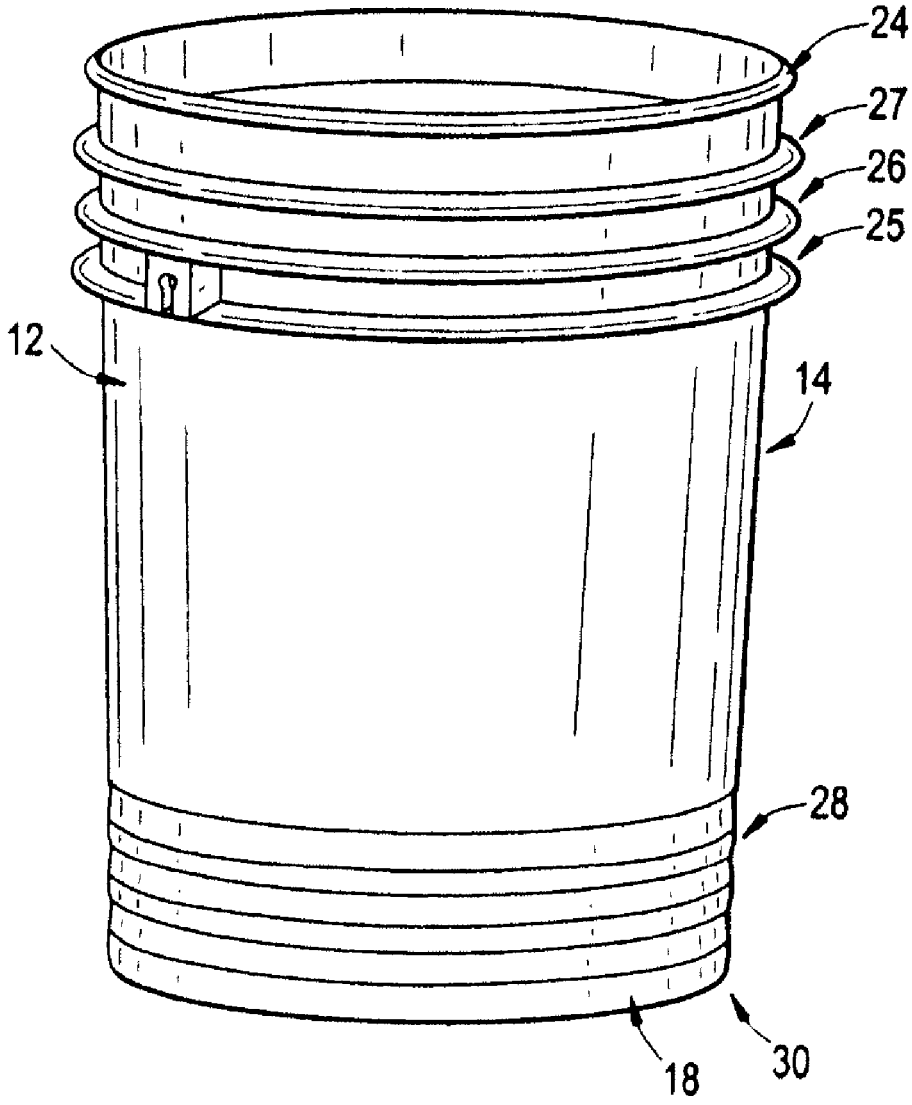
FIG. 3 is a perspective view of the pail of an exemplary embodiment of the invention.
Figure 4:
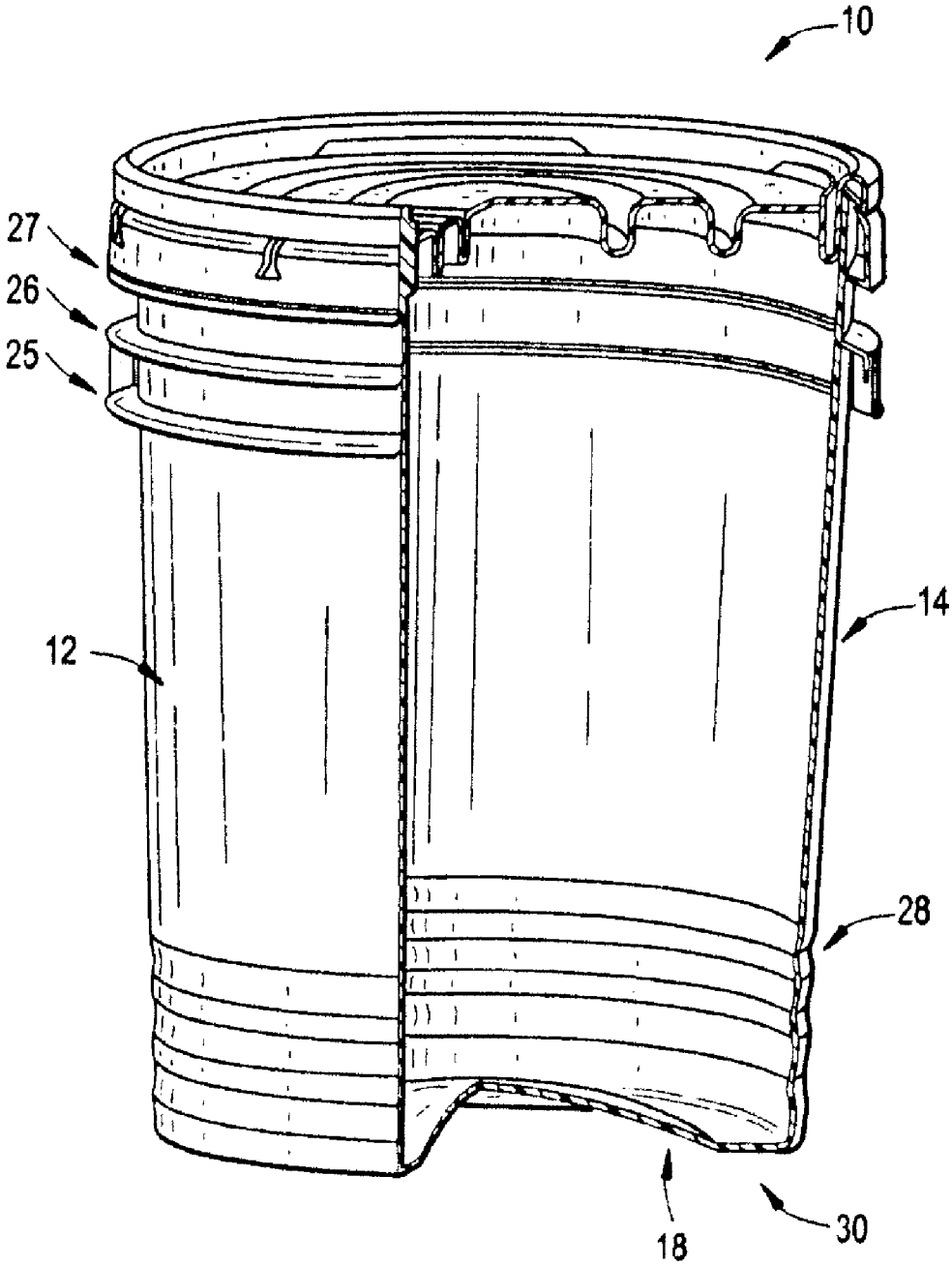
FIG. 4 is a perspective sectional view of the pail, gasket and cover of an exemplary embodiment of the invention.

Turning in detail to FIGS. 3 and 4, pail 12 comprises an angled bead 24 for interlocking or coupling with cover 20, one or more angled satellite rings 26 located generally and formed in the region of the proximal end of body 14, shock absorbing wall section 28 located generally and formed in the region of the distal end of body 14, and rounded corners 30 formed to connect body 14 to pail floor or bottom 18 which comprises a generally flat section which extends to form a dome-shaped or concave section which curves toward the interior of pail 12.

Angled bead 24 comprises a projecting rim or lip that extends circumferentially around the proximal end of body 14 and extends radially outward and downward from the proximal end of body 14. In another embodiment, angled bead 24 comprises one or more projecting rim segments that extend radially outward and downward from the proximal end of body 14. This particular embodiment of the invention illustrates first, second and third satellite rings 25, 26 and 27 which protrude circumferentially around body 14 to form three respective ridges which extend away from the external face of body 14. Although satellite rings 25, 26 and 27 are illustrated in a position that is angled downward toward the distal end of body 14, satellite rings 25, 26 and 27 can also be positioned perpendicular to body 14, or angled upward toward the proximal end of body 14. Satellite rings 25, 26 and 27 comprise respective proximal ends which are attached to and extend from body 14 to form a one-piece construction during the injection molding process. Satellite rings 25, 26 and 27 function to absorb forces that the external surface of pail 12 may be subjected to as container 10 undergoes a performance test or is transported from one location to another in actual use.

Figure 5:
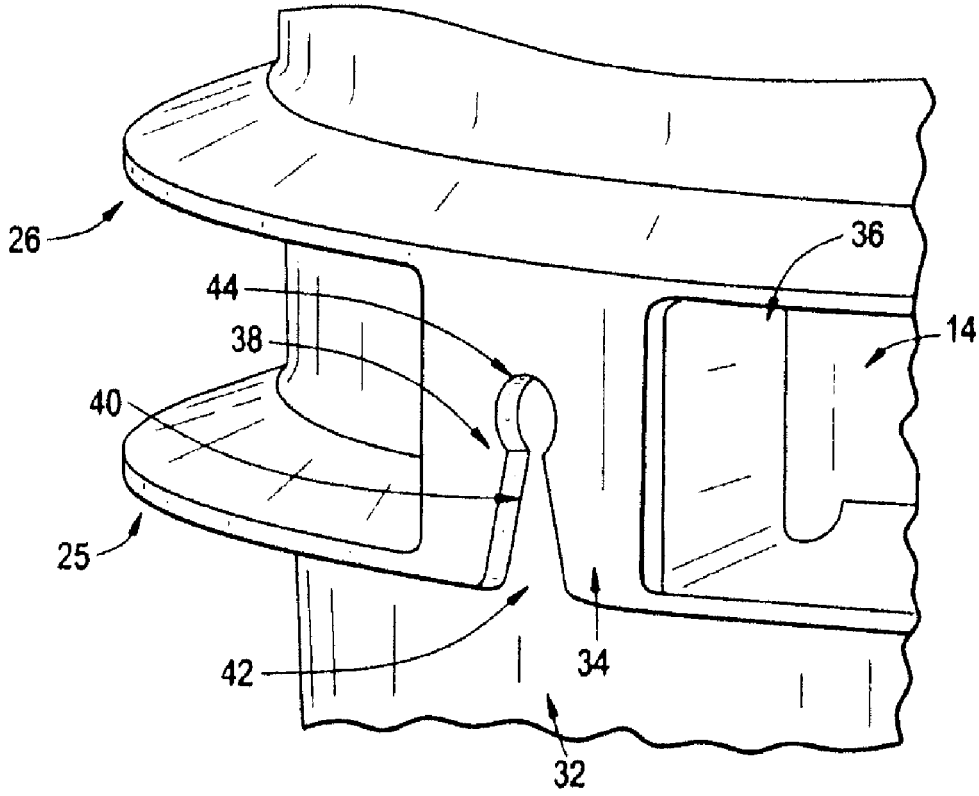
FIG. 5 is a perspective view of a bail ear in an exemplary embodiment of the invention.

Turning in detail to FIG. 5, one or more bail ears 32 are formed between satellite rings 25 and 26. Bail ear 32 comprises a first generally vertical support structure 34 positioned generally parallel to the external wall of body 14 and generally perpendicular to a second generally vertical support structure 36 which is also positioned generally perpendicular to the external wall of body 14. Vertical support structure 34 is configured to allow for the attachment of handle. In the exemplary embodiment illustrated in FIG. 5, vertical support structure 34 is shaped to define an opening 38 that comprises a channel portion 40 that tapers from a mouth area 42 to open into a generally semicircular seating portion 44. While not shown in FIG. 6, it should be appreciated that bail ear 32 can also comprise a third generally vertical support structure positioned on the opposing side of the first vertical support structure 34 from the second vertical support structure 36. While also not shown, it should be appreciated that a second bail ear 32 may be positioned on an opposed sidewall of the container 10. The pair of bail ears 32 allow for the attachment of a handle to pail 12. Such handles are commonly used in conjunction with containers such as pail 12 and are well known to persons of ordinary skill in the art.

Figure 6:
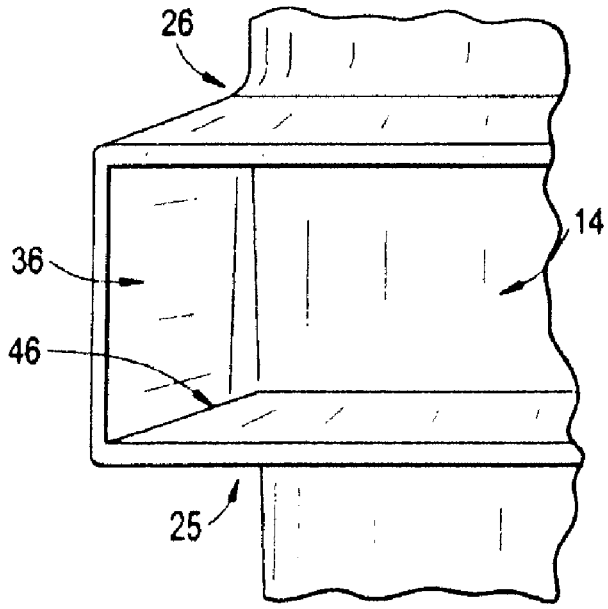
FIG. 6 is a perspective sectional view of a bail ear in an exemplary embodiment of the invention.

Turning in detail to FIG. 6, a perspective sectional view of bail ear 32 is illustrated. Vertical support structure 36 is formed between the satellite rings 26 and formed generally perpendicular to the external wall of body 14. Vertical support structure 36 and the external wall of body 14 are formed to provide separation slot 46 between vertical support structure 36 and the external wall of body 14. The formation of separation slot 46 between vertical support structure and the external wall of body 14, reduces the amount of plastic necessary to form bail ear 32 during the injection molding process resulting in a faster production cycle and at a reduced cost. In addition, separation slot 46 eliminates the wall junction between bail ear 32 and body 14 to facilitate a more rapid, even cooling of the plastic that comprises bail ear 32 during the injection molding process. Therefore, the elimination of the wall junction between bail ear 32 and body 14 results in improved pail structure and performance.

Figure 7:
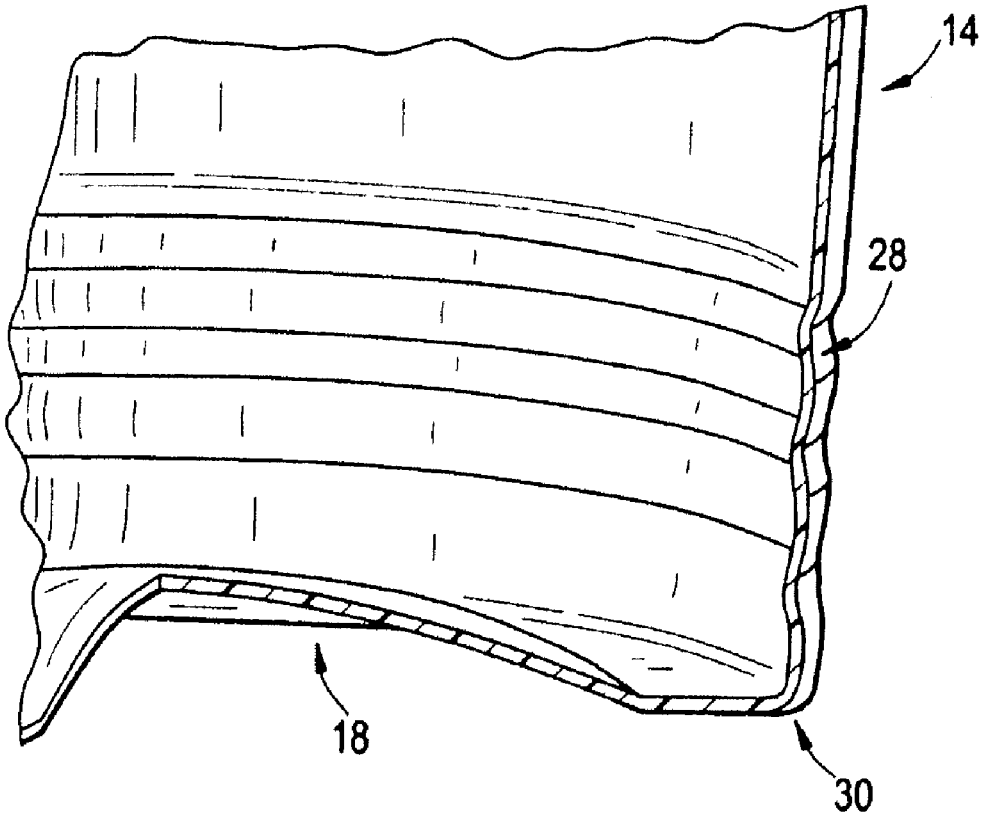
FIG. 7 is a perspective view of the lower portion of a pail in an exemplary embodiment of the invention.
Figure 8:
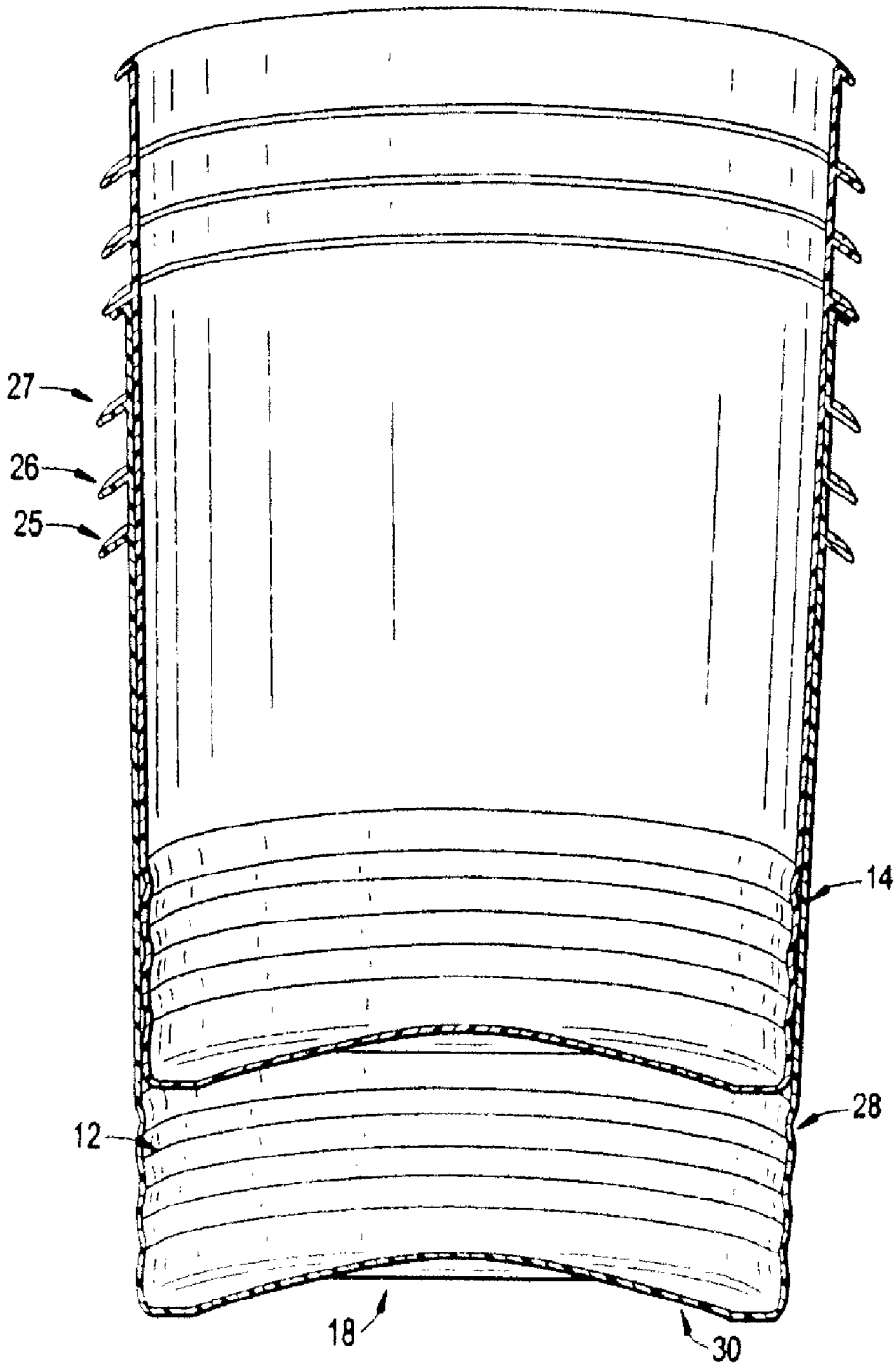
FIG. 8 is a perspective sectional view of the nesting detail of two pails in an exemplary embodiment of the invention.

Turning in detail to FIGS. 3, 4 and 7, this particular embodiment of the invention illustrates shock absorbing wall section 28 comprising a plurality of ring-type or c-shaped elements to form an accordion-like structure near the distal end of pail 12. In operation, shock absorbing wall section 28 and body 14 are formed as a single piece construction during an injection molding process. Furthermore, placement of the shock absorbing wall section 28 near the distal end of pail 12 allows for the efficient nesting of one pail inside of another matching pail when the pails are empty as shown in FIG. 8. However, it should be understood that shock absorbing wall section 28 can also be provided at any desired position on body 14 of pail 12 to meet desired performance requirements. Shock absorbing wall section 28 functions to absorb forces and the resulting stress that is imparted upon body 14 of pail 12 as container 10 is subjected to either a performance test such as the drop test discussed above, or in actual use as container 10 is used to transport liquids or other materials. Shock absorbing wall section 28 absorbs forces and the resulting stress that is imparted upon body 14 by allowing the ring-type or c-shaped elements which form an accordion like structure to flex or otherwise act as a shock absorbing mechanism or spring in response to an external force.

Figure 9:
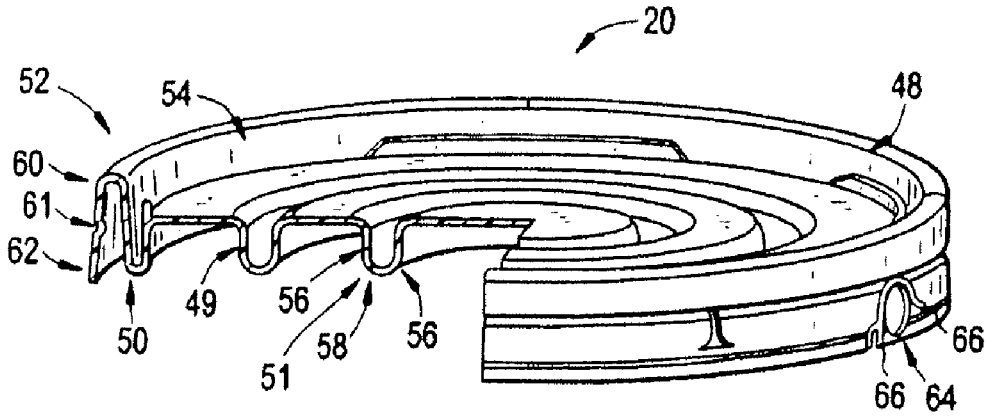
FIG. 9 is a perspective sectional view of the cover of an exemplary embodiment of the invention.

Turning in detail to FIG. 9, cover 20 comprises a cover surface 48, one or more radial u-channels 50 located generally and formed circumferentially within cover surface 48, a gripping flange 52 located generally and formed circumferentially around the outer portion of cover surface 48, and a centering ring 54 located generally and formed between the outer portion of cover surface 48 and gripping flange 52. When stacking the containers for storage or transport, centering ring 54 facilitates and stabilizes the containers when they are placed on top of each other. Centering ring 54 helps to ensure that all of the containers are centered and stacked uniformly, thus distributing the load of the column of containers more evenly and improving the stability of the containers during transport. Cover surface 48 comprises one or more substantially flat surfaces defined between the radial u-channels 50. In the embodiment of the invention illustrated in FIG. 8, cover 20 comprises a first, second and third radial u-channels 49, 50 and 51. Radial u-channels 49, 50 and 51 comprise a pair of sidewalls 56 that are coupled to cover surface 48 at their proximal end and a generally rounded or u-shaped member 58 that couples the pair of sidewalls 56 at their distal ends. Together, the pair of side walls 58 and the generally rounded u-shaped member 58 define a cavity within the radial u-channel 50. There is no limit or requirement regarding either the width or the depth of the radial u-channels 50. Radial u-channels 50 function as a spring or shock absorbing member, for example, if container 10 is impacted from the side during a performance test or in actual use. Upon receiving a force from a side impact, radial u-channels 50 flex in response to the lateral force. Similarly, radial u-channels 50 also function as a spring or shock absorbing member, for example, if container 10 experiences an increase in internal pressure. As the internal pressure of container 10 exerts an increased force on the internal surface of cover 20, thereby pushing cover 20 away from pail 12, radial u-channels 50 flex in response to the vertical force caused by the increase in internal pressure. Thus, radial u-channels 50 function to absorb both outside forces that may contact container 10 as well as internal forces resulting from increases in the pressure inside container 10, thereby helping to prevent failure of container 10 and leaking of the seal between cover 20 and pail 12.

Gripping flange 52 comprises a circumferential upper portion 60, a circumferential lower portion 62, and central member 61 that couples upper portion 60 to lower portion 62. Upper portion 60 is formed to connect gripping flange 52 to cover surface 48 This particular embodiment of the invention illustrates lower portion 62 which comprises a ring pull 64. Ring pull 64 comprises a substantially circular ring coupled to lower portion 62 with at least one connection member 66.

Figure 10:
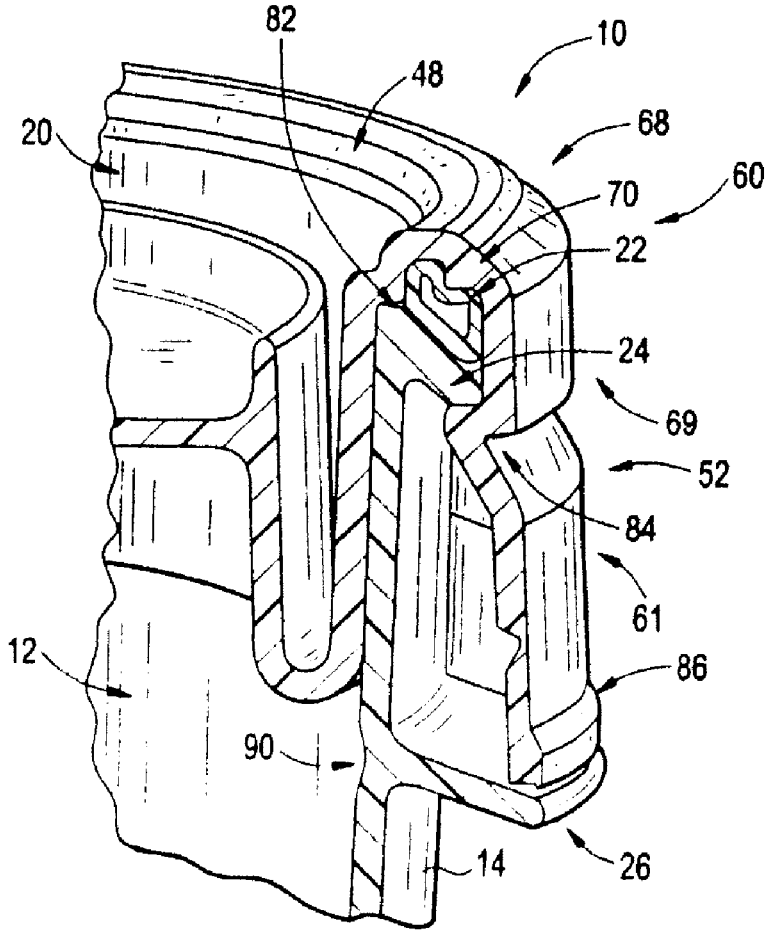
FIG. 10 is a perspective sectional view of the cover and pail of an exemplary embodiment of the invention.

Turning in detail to FIG. 10, one embodiment of the assembly detail of container 10 is illustrated. Container 10 comprises cover 20 coupled to pail 12 and gasket 22 disposed between cover 20 and pail 12. Upper portion 60 of gripping flange 52 comprises angled cover chime 68 and support member 69. Angled cover chime 68 extends circumferentially around upper portion 60 of gripping flange 52 and is formed to couple gripping flange 52 to cover surface 48. Angled cover chime 68 is also formed to extend generally radially outward and downward. In one embodiment of the invention, angled cover chime 68 is also formed substantially parallel to angled bead 24. The internal surface of angled cover chime 68 is formed to include gasket retainer bead 70. Gasket retainer bead 70 comprises a projection having a generally rounded edge that is formed to extend downward towards angled bead 24.

Gasket 22 comprises an outer tube made of vinyl or rubber, for example, that defines an internal cavity. Gasket 22 is disposed between and conforms to essentially fill the cavity defined by upper portion 60 of gripping flange 52 and angled bead 24. The surface of the angled bead 24 that contacts the gasket may extend downwardly toward the distal end of the body a distance greater than a thickness of a wall of the body, as illustrated in FIG. 10. In operation, when cover 20 is coupled to pail 12, gasket retainer bead 70 exerts increased tension on gasket 22. Gasket retainer bead 70 thereby functions to help maintain the position of gasket 22, particularly with respect to pressure increases inside of container 10. In addition, angled bead 24 and angled cover chime 68 operate in conjunction to force gasket 22 outward against support member 69. Thus, as pressure builds within container 10, for example, angled bead 24 and angled cover chime 68 help prevent gasket 22 from releasing and forming a leak. Instead, as pressure builds within container 10, the additional pressure is forced onto gasket 22 which, in turn, is retained by support member 69, angled cover chime 68 and angled bead 24.

Angled bead 24 is also formed to define cover rest area 82 at the top portion of the junction of angled bead 24 and body 14 of pail 12. Cover rest area 82 comprises a substantially flat surface that is configured to contact a corresponding substantially flat surface formed on an interior surface of upper portion 60 of gripping flange 52. Cover rest area 82 functions as a support member as cover 20 is subjected to external forces, for example, when one or more containers are stacked on top of the cover 20 of container 10.

Angled cover chime 68 is connected to central member 61 with support member 69. Central member 61 comprises engagement member 84 and wall section 86. Engagement member 84 comprises a projection that extends toward body 14 of pail 12 between satellite ring 26 and angled bead 24, thereby defining an indent that extends circumferentially around the external surface of central member 61. The formation of engagement member 84 reduces the amount of plastic necessary to form gripping flange 52 resulting in a faster production cycle and at a reduced cost. In addition, the reduced amount of material used during the injection molding process facilitates a more rapid, even cooling of the plastic, thereby helping to promote consistent and improved strength throughout the component.

In order to place cover 20 onto pail 12, a portion of gripping flange 52 is flexed slightly outward as cover 20 is lowered onto pail 12, such that engagement member 84 is able to clear angled bead 24. Once engagement member 84 has cleared angled bead 24, engagement member 84 returns to its pre-flexed configuration allowing a portion of engagement member 84 to be snapped into place to position a portion of engagement member 84 in contact with the bottom lip or edge formed by angled bead 24. Once cover 20 has been engaged with pail 12, cover 20 is effectively locked in place and a hermetic seal is formed. Conversely, to remove cover 20, lower portion 62 of gripping flange 52 functions as a tear strip that can be removed from central portion 61 along a circumferential tear line by exerting a force on ring pull 64. The tear strip also functions as a tamper evidence feature and enables end users to remove cover 20 without any tools.

Satellite ring 26 comprises a proximal end which is attached to and protrudes from body 14 to form a single piece construction during the injection molding process. In the embodiment of the invention that is illustrated, body 14 of pail 12 is molded to form an indent 90 on the inner surface of body 14 of pail 12. Indent 90 allows the wall junction of satellite ring 26 and body 14 to have a substantially constant thickness through their wall junction. By providing indent 90 on the inner surface of body 14 at the wall junction of satellite ring 26 and body 14, a reduced amount of plastic is used to form the wall junction of satellite ring 26 and body 14 during the injection molding process. This allows the component to be produced with a faster production cycle and at a reduced cost. In addition, the substantially uniform thickness of the wall junction of satellite ring 26 and body 14 facilitates a more rapid, even cooling of the plastic throughout the wall junction, thereby helping to promote consistent strength throughout the pail.

While certain embodiments of the inventions have been described above, it will be understood that the embodiments described are by way of example only. Accordingly, the inventions should not be limited based on the described embodiments. Rather, the scope of the inventions described herein should only be limited in light of the claims that follow when taken in conjunction with the above description and accompanying drawings.

What is claimed:

1. A container comprising:

a body comprising a proximal end and a distal end and a floor sealing the distal end of the body to define an internal cavity;

a plurality of satellite rings extending peripherally from the body; and a bail ear connecting at least two satellite rings to form an opening between the bail ear and the body, the bail ear including a first support structure configured to allow for the attachment of a handle and a second support structure extending between the at least two satellite rings and extending from the first support structure toward the body, wherein the second support structure and the body are separated.

2. The container of claim 1, wherein the first support structure is positioned parallel to the body; and wherein the second support structure is coupled to the first support structure and positioned perpendicular to the first support structure and the body.

3. The container of claim 1, wherein the inner surface of the body forms an indent at the wall junction formed by each satellite ring and the body to reduce the thickness of the wall junction.

4. The container of claim 1, further comprising an angled bead formed at the proximal end of the body.

5. The container of claim 4, further comprising a cover configured to be removably coupled to the proximal end of the body.

6. The container of claim 5, wherein the cover further comprises a gripping flange configured to interlock with the angled bead.

7. The container of claim 6, wherein the cover further comprises an angled cover chime formed peripherally around the gripping flange, wherein the angled cover chime comprises a rim that extends radially outward and toward the distal end of the body.

8. The container of claim 7, wherein the angled cover chime is substantially parallel to the angled bead when the cover is coupled to the body.

* * * * *